US007835654B2

(12) United States Patent
Fujimoto

(10) Patent No.: US 7,835,654 B2
(45) Date of Patent: Nov. 16, 2010

(54) FIXING APPARATUS IN WHICH A FIXING NIP IS SECURED BY A PRESSURE BELT AND A FIXING ROLLER, AND IMAGE FORMATION APPARATUS THAT INCLUDES THE FIXING APPARATUS

(75) Inventor: Yoshihisa Fujimoto, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 65 days.

(21) Appl. No.: 12/179,732

(22) Filed: Jul. 25, 2008

(65) Prior Publication Data

US 2009/0052925 A1 Feb. 26, 2009

(30) Foreign Application Priority Data

Aug. 21, 2007 (JP) ..... 2007-214635

(51) Int. Cl.
*G03G 15/20* (2006.01)

(52) U.S. Cl. ..... 399/45; 399/67; 399/329

(58) Field of Classification Search ..... 399/45, 399/67, 329, 328, 334, 320; 219/216; 347/156
See application file for complete search history.

(56) References Cited

U.S. PATENT DOCUMENTS

| | | | | |
|---|---|---|---|---|
| 7,447,472 | B2 | 11/2008 | Sugiyama | |
| 2005/0191071 | A1 * | 9/2005 | Katayanagi et al. | 399/45 |
| 2007/0048044 | A1 | 3/2007 | Tokuhiro et al. | |
| 2008/0095557 | A1 * | 4/2008 | Horie | 399/329 |
| 2009/0074487 | A1 * | 3/2009 | Fujii | 399/329 |

FOREIGN PATENT DOCUMENTS

| | | | |
|---|---|---|---|
| JP | 10-228200 | A | 8/1998 |
| JP | 2001-005312 | | 1/2001 |
| JP | 2003-307951 | A | 10/2003 |
| JP | 2004-085880 | A | 3/2004 |
| JP | 2005-189746 | | 7/2005 |
| JP | 2005-300732 | A | 10/2005 |
| JP | 2007-057733 | | 3/2007 |
| JP | 2007-121707 | A * | 5/2007 |

OTHER PUBLICATIONS

Notification of Reasons for Rejection issued in corresponding Japanese Application No. JP 2007-214635 dated Aug. 11, 2009, and a verified English Translation thereof.

* cited by examiner

*Primary Examiner*—Sophia S Chen
(74) *Attorney, Agent, or Firm*—Buchanan Ingersoll & Rooney PC

(57) ABSTRACT

A belt-nip system fixing apparatus reduces the frequency of replacing a pressure belt or a sliding sheet. In accordance with a sheet measurement in a roller axis direction, the fixing apparatus switches a pressure distribution in the roller axis direction between a low-pressure load distribution in which pressure is greatest at a center pressure switching projection of a hard pad, and pressure gradually lessens towards pressure switching projections near the ends of the hard pad, and the pressure in a range of 216 [mm] in a center in the roller axis direction is greater than or equal to a necessary pressure for fixing (a predetermined value Nm) while the pressure in other projections near the ends is below the predetermined value Nm, and a high-pressure load distribution in which the pressure throughout the total area in the roller axis direction equals or exceeds the predetermined value Nm.

6 Claims, 8 Drawing Sheets

FIG.7

| SHEET SIZE | A3 PORTRAIT | A4 PORTRAIT | A4 LANDSCAPE | B4 PORTRAIT | B5 PORTRAIT | B5 LANDSCAPE |
|---|---|---|---|---|---|---|
| SHEET MEASUREMENT [mm] | 297 | 210 | 297 | 257 | 182 | 257 |
| PRESSURE DISTRIBUTION | P1 | P2 | P1 | P1 | P2 | P1 |

FIXING APPARATUS IN WHICH A FIXING NIP IS SECURED BY A PRESSURE BELT AND A FIXING ROLLER, AND IMAGE FORMATION APPARATUS THAT INCLUDES THE FIXING APPARATUS

This application is based on application No.2007-214635 filed in Japan, the content of which is hereby incorporated by reference.

BACKGROUND OF THE INVENTION

1. Field of the Invention

The present invention relates to a fixing apparatus that fixes an unfixed image on a recording sheet by passing the recording sheet through a fixing nip, and an image formation apparatus that includes the fixing apparatus.

2. Related Art

In fixing apparatuses included in image formation apparatuses such as copiers, there is a so-called belt-nip system in which a fixing nip is secured by pressing a pressure belt against a fixing roller, and an unfixed image formed from toner or the like on a recording sheet is fixed thereon by passing the recording sheet between the pressure belt and the fixing roller (see Japanese Patent Application Publication No. 2005-300732).

In a belt-nip system fixing apparatus, a pressing member that presses the pressure belt towards the fixing roller is disposed on an inner face of the pressure belt, and the fixing nip is secured between the pressure belt and the fixing roller by the pressure. The pressure belt generally is driven to rotate by the driving rotation of the fixing roller. Interposing, for example, a low friction sheet for reducing friction between the pressure belt and the pressing member enables reducing the friction between the pressed portions.

However, the friction between the pressure belt and the pressing member cannot be completely eliminated even with use of the low friction sheet, and when the pressure belt, etc. erodes with the passage of time, thereby increasing the frictional force, the drive load on the pressure belt increases due to the frictional force.

When the drive load on the pressure belt increases, there is a brake effect on the driven pressure belt, though the fixing roller tries to continue rotation as usual. When a recording sheet having an unfixed toner image formed thereon passes between the fixing roller and the pressure belt, there are cases when image slippage occurs due to the toner image on the recording sheet shifting on the recording sheet as if sliding.

Conventionally, replacement of the pressure belt, etc., is performed frequently to prevent this type of image slippage occurring over time.

SUMMARY OF THE INVENTION

However, performing frequent replacement leads to a commensurate increase in labor time and cost.

The present invention has been achieved in view of the above problem, and an aim thereof is to provide a fixing apparatus that can reduce the frequency of replacement of the pressure belt, etc. while preventing image slippage, and an image formation apparatus including the fixing apparatus.

In order to achieve the above aim, one aspect of the image formation apparatus of the present invention is a fixing apparatus that fixes a toner image formed on a sheet by passing the sheet through a fixing nip, comprising a roller that is rotatably held; a belt that revolves; a pressing member disposed on an inner face of the belt, the pressing member pressing the belt from the inner face against a surface of the roller so that the fixing nip is formed between the belt and the roller; and a pressure controller that, in accordance with information indicating a measurement of the sheet in a roller axis direction, changes a pressure distribution in the roller axis direction, the pressure distribution being a distribution of the pressure applied to the roller by the pressing member.

According to the above structure, the pressure controller changes the pressure distribution according to information indicating the measurement of the sheet in the roller axis direction, thereby enabling the fixing apparatus of the present invention to reduce erosion of the pressure belt, etc., more than a case in which a pressure greater than or equal to a necessary pressure for fixing unfixed images is constantly applied to the entire area of the fixing nip in the roller axis direction. Since reducing erosion of the belt, etc. enables suppressing the drive load on the belt and reducing the brake effect, occurrence of image slippage when fixing an unfixed image can be suppressed. Accordingly, the fixing apparatus pertaining to the present invention can reduce the frequency of replacing the belt, etc., while preventing occurrences of image slippage.

In the fixing apparatus, if the measurement of the sheet that is to pass through the fixing nip is of a first size, the pressure controller may cause the pressing member to use a first pressure distribution in which a pressure on a site through which the sheet of the first size is anticipated to pass is greater than or equal to a necessary fixing pressure and a pressure on other sites is below the necessary fixing pressure, and if the measurement of the sheet that is to pass through the fixing nip is of a second size that exceeds the first size, the pressure controller may cause the pressing member to use a second pressure distribution in which a pressure on all sites is greater than or equal to the necessary fixing pressure. According to this structure, it is possible to apply sufficient pressure to the portion of the fixing nip necessary for fixing an unfixed image, and when the sheet is the first size, to reduce pressure applied to other portions of the fixing nip not necessary for fixing. Changing the pressure distribution in this way suppresses erosion of the belt on the other portions in the fixing nip, thereby enabling reducing the frequency of replacing the belt, etc., while preventing occurrences of image slippage.

In the fixing apparatus, the pressing member may be made of an elongated, bendable bar material, a plurality of pectinate projections being formed on one face thereof, a central one of the projections, with respect to a length direction of the pressing member, may project farther than ones of the projections in a vicinity of ends of the pressing member, the pressure controller may include a support member that supports the pressing member, and a pressure applicator, the support member supporting the pressing member so as to at least be in contact with the central projection, the pressure applicator applying pressure to the pressing member via the support member, and if the sheet is of the first size, the pressure applicator may apply a first pressure, and if the sheet is of the second size, the pressure applicator may apply second pressure that is greater than the first pressure.

According to this structure, changing the pressure enables changing the pressure distribution.

Specifically, the fixing apparatus may be achieved such that while the first pressure is being applied, only the farthest-projecting central projection of the pressing member is in contact with the support member, and the pressure applied to the fixing nip is transmitted only via the central projection, and while the second pressure is being applied, all of the projections are in contact with the support member, and the pressure applied to the fixing nip is transmitted via all of the projections. This structure enables realization of changing the pressure distribution.

Also, in order to achieve the above aim, another aspect of the present invention is an image formation apparatus that forms an image on a sheet by passing the sheet through a fixing nip and fixing a toner image on the sheet, comprising a roller that is rotatably held; a belt that revolves; a pressing member, provided on an inner side of the belt and held in a state of pressing against a surface of the roller via the belt, so that the fixing nip is formed between the belt and the roller; a judgment part that judges a size of the sheet to be conveyed through the fixing nip; and a pressure controller that, in accordance with the judged measurement of the sheet in a roller axis direction, changes a pressure distribution in the roller axis direction, the pressure distribution being a distribution of the pressure applied to the roller by the pressing member.

According to the above structure, in the image formation apparatus of the present invention, by employing the above structure, the pressure controller can change the pressure in the roller axis direction in accordance with the size of the sheet judged by the judgment unit. Accordingly, the image formation apparatus of the present invention can reduce erosion of the pressure belt, etc., unlike a case in which pressure greater than or equal to a necessary pressure for fixing unfixed images is constantly applied to the entire area of the fixing nip in the roller axis direction. Reducing erosion of the belt, etc. enables suppressing an increase in the drive load on the belt, and reducing the brake effect on the belt, thereby suppressing occurrences of image slippage when fixing an unfixed image. Accordingly, the image formation apparatus of the present invention can reduce the replacement frequency of the belt, etc., while preventing occurrences of image slippage.

In the image fixing apparatus, the pressing member may be elongated in shape, and the pressure controller may change the pressure applied to an end of the pressing member in a length direction. According to this structure, merely changing the pressure applied to the ends enables realizing the above effect.

In the image formation apparatus, the pressure controller may switch, in accordance with the size of the sheet, between a first state in which the pressure at the end of the pressing member is greater than or equal to a predetermined pressure necessary for fixing, and a second state in which the pressure at the end of the pressing member is less than the predetermined pressure necessary for fixing. According to this structure, when the sheet is of a large enough size to pass through the areas of the fixing nip on the ends, the pressure controller switches to the first state, and when the sheet is not of a large enough size to pass through the areas of the fixing nip on the ends, the pressure controller switches to the second state. Accordingly, reducing the pressure in areas of the fixing nip not necessary for fixing enables reducing erosion of the belt etc., on the ends, and reducing the frequency of replacing the belt etc., while preventing occurrences of image slippage.

In the image forming apparatus, the pressure controller may maintain the second state when image formation is not being performed. This structure enables reducing pressure acting on the roller from the inner face of the belt on the ends of the pressing member, suppressing the load on the roller ends, and suppressing deformation of the roller when not performing image formation, unlike a case of maintaining the first state when not performing image formation.

BRIEF DESCRIPTION OF THE DRAWINGS

These and other objects, advantages, and features of the invention will become apparent from the following description thereof taken in conjunction with the accompanying drawings, which illustrate a specific embodiment of the present invention.

In the drawings:

FIG. 7 shows the content of pressure distribution information; and

DETAILED DESCRIPTION OF PREFERRED EMBODIMENTS

The following describes a tandem-type color digital printer (hereinafter, referred to simply as a "printer") as an example of the fixing apparatus of the present invention. Note that although the printer embodying the technological idea of the present invention is given as an example in the following embodiment, the present invention is not limited to this.

Printer Structure

Figure 1:
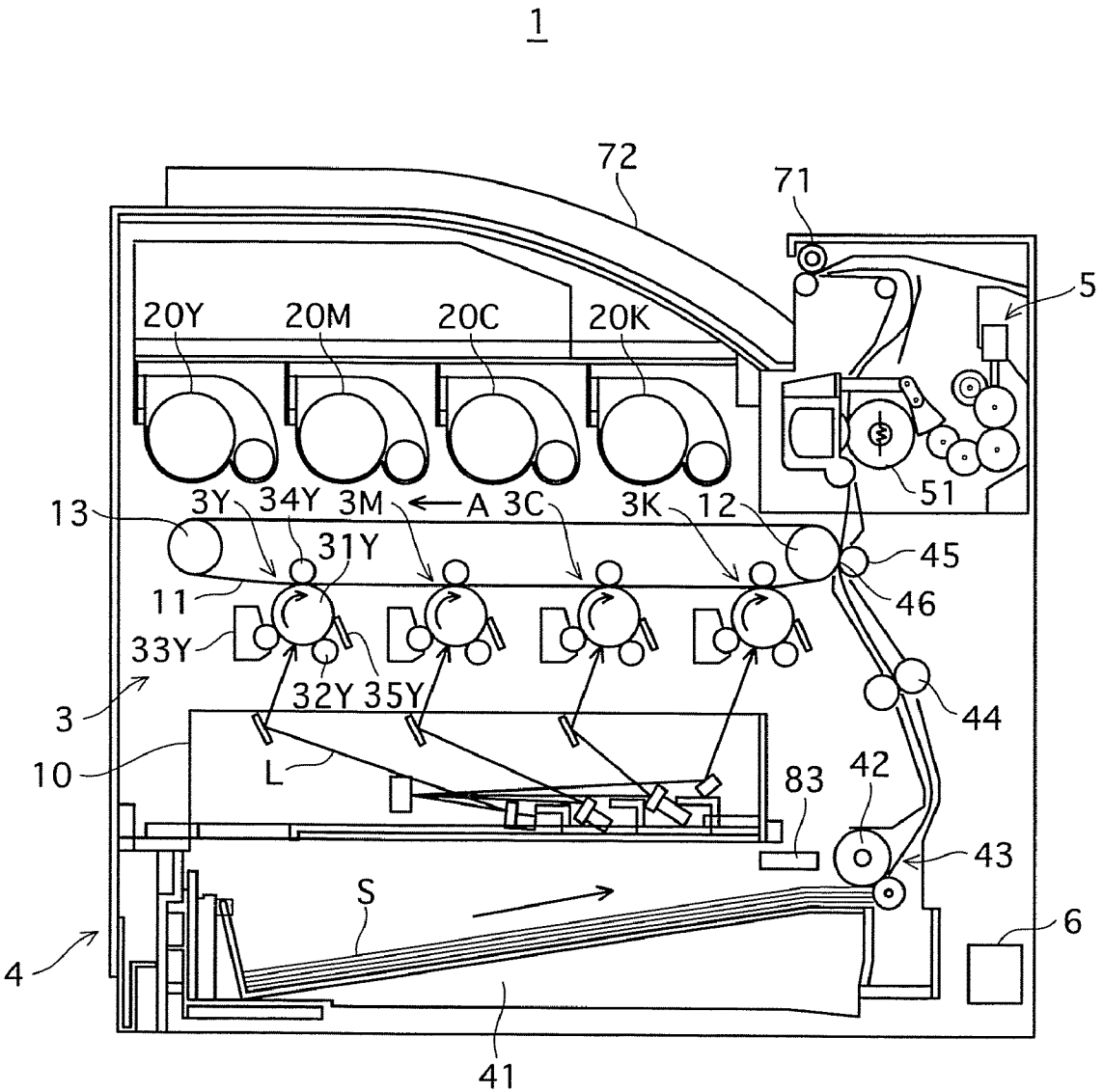
FIG. 1 is a schematic sectional view showing a structure of a printer pertaining to the embodiment.

FIG. 1 is a schematic sectional view showing a structure of a printer 1 pertaining to the present embodiment.

As shown in FIG. 1, the printer 1 includes an image processor 3, a feeder 4, a fixer 5, and a controller 6. The printer 1 is connected to a network such as a LAN, and upon receiving a print job execution instruction from an external terminal apparatus (not depicted), executes color image formation in accordance with the instruction, the color image being composed of colors yellow, magenta, cyan, and black. The yellow, magenta, cyan and black reproduction colors are hereinafter represented as Y, M, C, and K respectively, and the letters Y, M, C, and K have been appended to numbers pertaining to the reproduction colors.

The image processor 3 includes image formers 3Y, 3M, 3C, and 3K corresponding to the colors Y to K respectively, an optical part 10, an intermediate transfer belt 11, and hoppers 20Y, 20M, 20C, and 20K, etc.

The image former 3Y includes a photoreceptor drum 31Y, and a charger 32Y, a developer 33Y, a primary transfer roller 34Y, a cleaner 35Y for cleaning the photoreceptor drum 31Y, and the like are disposed surrounding the photoreceptor drum 31Y. The image former 3Y forms a color Y toner image on the photoreceptor drum 31Y. Other image formers 3M to 3K also have similar structures to the image former 3Y, and reference notations thereof are omitted in FIG. 1.

The hoppers 20Y to 20K contain toner for replenishing the colors Y to K, and supply toner as needed to the developers 33Y to 33K respectively.

The optical part 10 includes a laser diode as a luminous element, and emits a laser beam L for exposing the photoreceptor drums 31Y to 31K.

The intermediate transfer belt 11 is an endless belt that is suspended in a tensioned state on a driving roller 12 and a driven roller 13, and is rotated in the direction of arrow A.

The feeder 4 includes a paper feed cassette 41 that contains a sheet S as a recording sheet, a feeding roller 42 that feeds the sheet S of the paper feed cassette 41 on a conveyance path 43 one sheet at a time, a timing roller pair 44 for adjusting a timing at which to send the fed sheet S to a secondary transfer position 46, a secondary transfer roller 45, etc. The paper feed cassette 41 can be set for different sheet sizes, such as A3, A4, and A5.

The controller 6 converts an image signal from the external terminal apparatus into digital signals for colors Y to K, and generates a driving signal for driving the luminous element of the optical part 10.

In accordance with a driving signal from the controller 6, the optical part 10 emits the laser beam L for image formation in colors Y to K, and scans the laser beams across the photoreceptor drums 31Y to 31K. This exposure scanning forms electrostatic latent images on the photoreceptor drums 31Y to 31K that have been uniformly charged by the chargers 32Y to 32K. The electrostatic latent images are elicited by the developers 33Y to 33K with use of the toner, and toner images of colors Y to K are formed on the photoreceptor drums 31Y to 31K.

The color toner images are sequentially transferred to the intermediate transfer belt 11 by electrostatic power acting on the primary transfer rollers 34Y to 34K. At this time, the image forming operation for each color is executed at different timings so that the toner images are superimposed on the same position on the intermediate transfer belt 11. The toner images for each color that have been superimposed on the intermediate transfer belt 11 are transported by the rotation of the intermediate transfer belt 11 to the secondary transfer position 46.

Meanwhile, the sheet S is fed from the feeder 4 via the timing roller pair 44 at the timing of transport by the intermediate transfer belt 11. The sheet S is conveyed sandwiched between the rotating intermediate transfer belt 11 and the secondary transfer roller 45. The toner images on the intermediate transfer belt 11 are collectively secondarily transferred to the sheet S by electrostatic power acting on the secondary roller 45.

The sheet S that has passed the secondary transfer position 46 is conveyed to the fixer 5. After the toner images on the sheet S (unfixed images) are fixed thereto by the fixer 5 by heat and pressure, the sheet S is discharged to the discharge tray 72 via a discharge roller pair 71. Note that a sheet size detection sensor 83 is disposed on an upper portion of the paper feed cassette 41 for detecting sheet size.

Structure of Fixer 5

Figure 2:
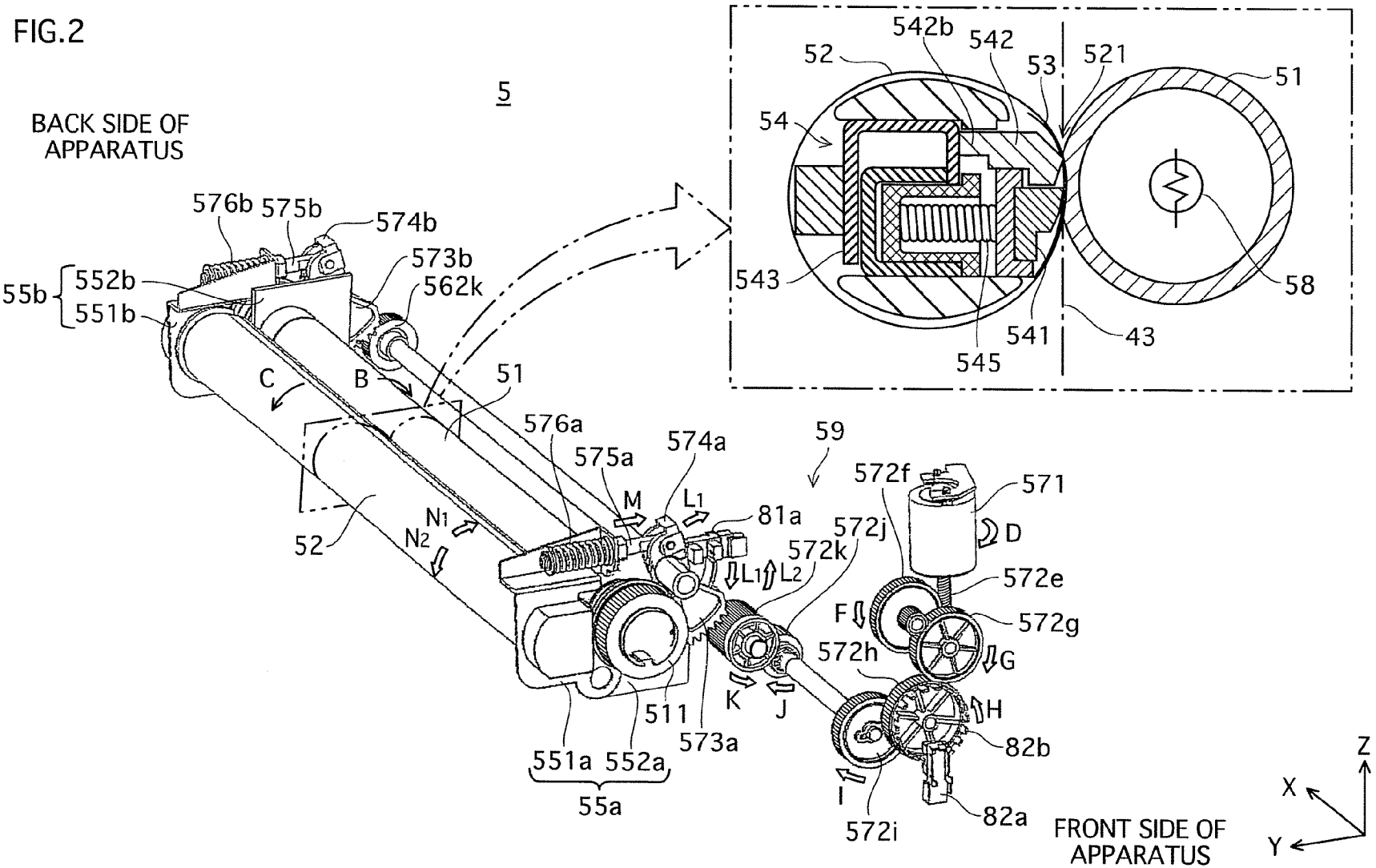
FIG. 2 is a perspective view of a fixer pertaining to the embodiment.

FIG. 2 shows a schematic perspective view of the fixer 5 along with an enlarged cross-sectional view of main parts thereof.

As shown in FIG. 2, the fixer 5 is a belt-nip system fixing apparatus that includes the fixing roller 51, a pressure belt 52, and a pressure applicator 59.

The ends of the fixing roller 51 at the front and back of the apparatus are rotatably held by axis support plates 552*a* and 552*b*. The axis support plates 552*a* and 552*b* are affixed to a main frame (not depicted) of the fixer 5. A gear 511 is mounted to one end of the fixing roller 51, and due to the gear 511 receiving a rotation driving force from a driving motor (not depicted), the fixing roller 51 is driven to rotate in, for example, a direction B. A heater 58 is provided on an inner portion of the fixing roller 51.

The pressure belt 52 is an endless belt that is revolvably held by holding bodies 551*a* and 551*b*, and while being pressed by the fixing roller 51, receives a rotation driving force from the fixing roller 51 and is driven to revolve in a direction C. A pressing body 54 is disposed on an inner portion of the pressure belt 52.

The pressing body 54 presses the pressure belt 52 from behind via a sliding sheet 53 provided for reducing friction, and presses the pressure belt 52 against the fixing roller 51. In this way, the fixing nip 521 is secured.

The pressing body 54 is composed of a soft pad 541 that is made of a soft material, a hard pad 542 that is made of a hard material, and a support member 543 that supports the pads.

The soft pad 541 is supported by the support member 543 via a compression spring 545, and receives the restoring force of the compression spring 545 to press on the pressure belt 52.

The hard pad 542 is made of, for example, resin or metal, and is provided in a position further downstream, in the direction of sheet conveyance, than the soft pad 541. The end of the hard pad 542 is mountain-shaped. The hard pad 542 presses against the pressure belt 52 so as to cause the pressure belt 52 to dig into the fixing roller 51. This enables easier separation of the sheet S, which has passed through the fixing nip 521, from the pressure belt 52, prevents the sheet S from becoming wound around the pressure belt 52, and improves the conveyability of the sheet S.

Inner Structure of Pressure Belt 52

Figure 3:
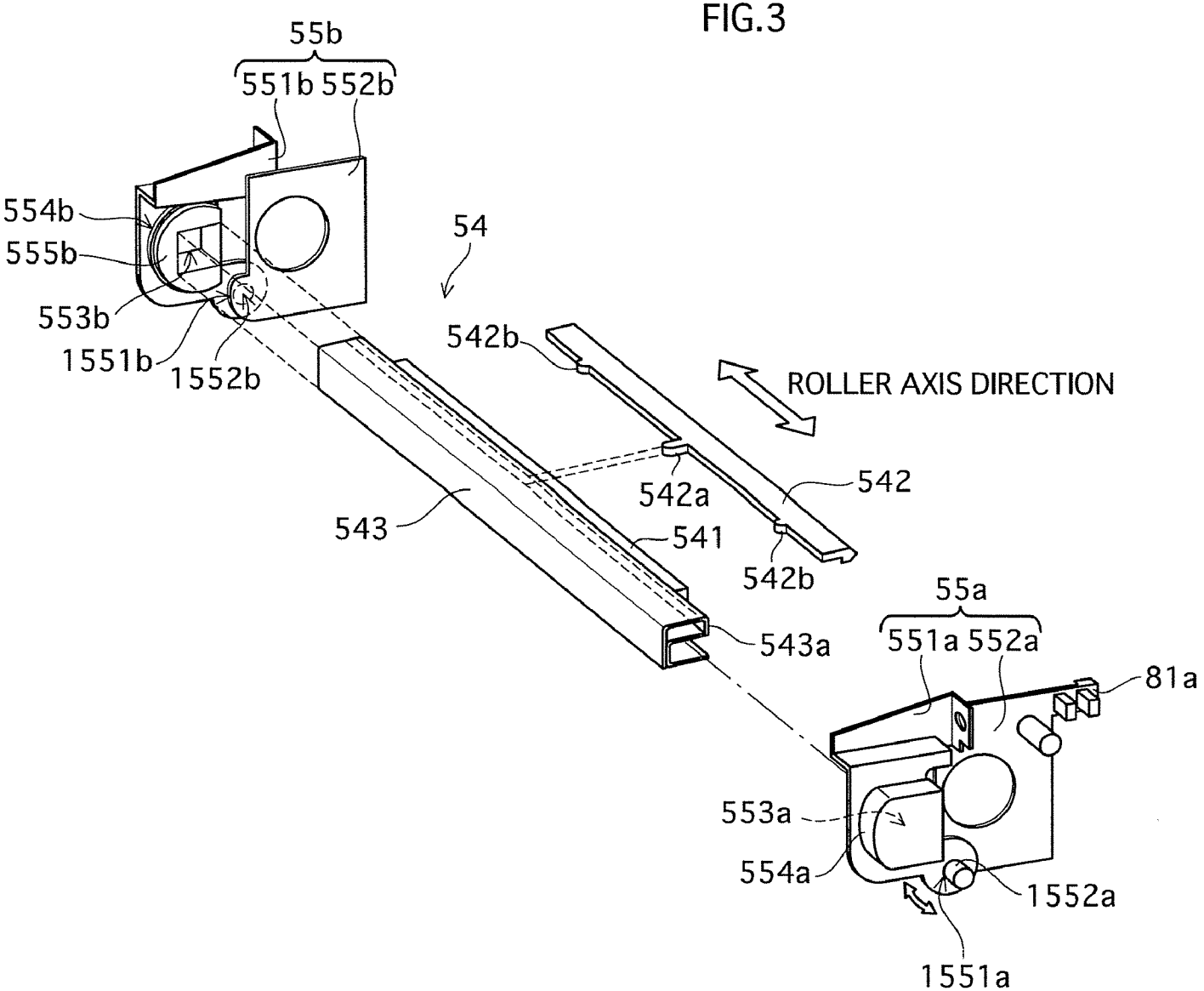
FIG. 3 is an exploded view showing a pressing part of the fixer and main parts in a vicinity thereof.

FIG. 3 is a perspective view showing the structure of the hard pad 542 and the support member 543.

As shown in FIG. 3, the hard pad 542 has an elongated shape. A wall of the hard pad 542 facing the supporting member 543 has provided thereon a projection 542*a* in a substantially central position in the length direction, and a pair of projections 542*b*, each of which is provided near a different side of the 542 at substantially the same intervals from the central projection 542*a*. The two projections 542*b* near the sides project the same amount as each other, and the central projection 542*a* projects farther than the two projections 542*b* near the sides.

The projections 542*a* and 542*b* are for switching between two levels of pressure force distribution in a direction orthogonal to the sheet conveyance direction (hereinafter called a "roller axis direction") in the fixing nip 521. The details of switching the pressure force distribution are described later.

The support member 543 has an elongated shape, is composed of a metal such as aluminum or iron, and supports the hard pad 542 and the soft pad 541 in such a way that the hard pad 542 is resting on the soft pad 541. A wall 543*a* of the support member 543 facing the hard pad 542 is substantially planar.

Both ends in a length direction of the support member 543 have been tightly fit in holes 553*a* and 553*b* of holders 554*a* and 554*b*. A small-diameter part 555*b* of the holder 554*b* has been inserted into an inner portion of the pressure belt 52 (see FIG. 2), and similarly, a small-diameter part (not depicted) of the holder 554*a* has been inserted into an inner portion of the pressure belt 52, thereby rotatably supporting the pressure belt 52.

Through-holes 1551*a* and 1551*b* have been provided on a lower portion of the holding bodies 551*a* and 551*b*, and axis parts 1552*a* and 1552*b* of the axis support plates 552*a* and 552*b* have been inserted through the through-holes 1551*a* and 1551*b*. In this way, the holding bodies 551*a* and 551*b* are rotatably supported by the axis parts 1552*a* and 1552*b* of the axis support plates 552*a* and 552*b*.

Structure of Pressure Applicator 59

As shown in FIG. 2, the pressure applicator 59 is for applying pressure for pressing the pressure belt 52 against the fixing roller 51, and includes a pressure switch motor 571, a row of gears 572*e* to 572*k* (idle gear, deceleration gear, etc.), a fan-shaped gear 573*a*, a link plate 574*a*, a rod 575*a*, a compression coil spring 576*a*, etc.

The pressure switch motor 571 is a driving source, and the driving force thereof is transmitted to the fan-shaped gear 573*a* via the row of gears 572*e* to 572*k*.

Figure 4:
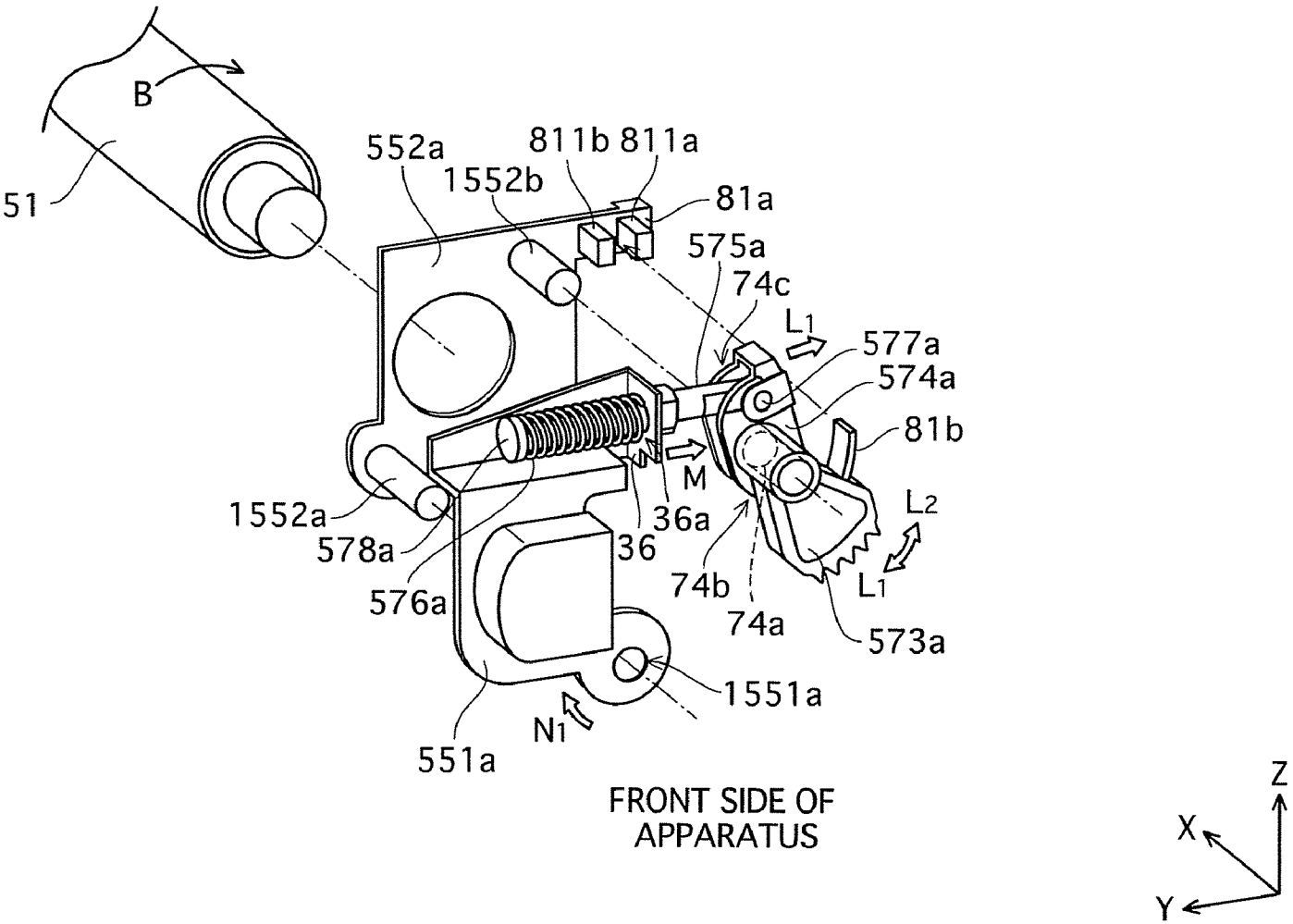
FIG. 4 is an exploded perspective view showing main parts in a vicinity of an end of a fixing roller of the fixer.

FIG. 4 is a perspective view showing the fan-shaped gear 573*a* and an exploded view of members in a vicinity thereof.

As shown in FIG. 4, the fan-shaped gear 573*a* is fixed to the oval-shaped link plate 574*a* on one side of an arch 74*b*. A through-hole 74*a* is provided in the link plate 574*a*, and the axis part 1552*b*, which is provided on the axis support plate 552*a*, is inserted through the through-hole 74*a*. In this way, the link plate 574*a* oscillates freely around the axis part 1552*a*, and the link plate 574*a* is supported by the axis support plate 552*a*.

One end of the rod 575*a* is connected, via an axis 577*a*, to an arch 74*c* of on the other side of the link plate 574*a* so as to oscillate freely around the axis 577*a*.

The other end of the rod 575*a* extends out in the Y direction via a through-hole 36*a* provided on a wall 36 of the holding body 551*a*, and a latch part 578*a* is provided for preventing the compression coil spring 576*a* from detaching. The compression coil spring 576*a* is fit around a portion of the rod 575*a* from the latch part 578*a* to the wall 36 of the holding body 551*a*. Note that although the structure of the front side of the apparatus is described, the back side also has a similar structure.

Operation of Pressure Applicator 59

In this type of structure, when the pressure switch motor 571 is driven to rotate in a direction D shown in FIG. 2 (hereinafter called "clockwise"), the row of gears 572*e* to 572*k* rotates in directions D to K. In accordance with this rotation, the fan-shaped gears 573*a* and 573*b* oscillate in a direction L1, the link plates 574*a* and 574*b* oscillate in the direction L1, the rods 575*a* and 575*b* are pulled in an M direction, and the tension causes the holding bodies 551*a* and 551*b* to oscillate in an N1 direction, via the compression springs 576*a* and 576*b*. The oscillation force in the N1 direction of the holding bodies 551*a* and 551*b* is transmitted to the hard pad 542 via the support member 543, and the hard pad 542 applies pressure to the fixing roller 51 via the pressure belt 52. This pressure becomes stronger as the rotation rate of the pressure switch motor 571 increases.

Meanwhile, when the pressure switch motor 571 reverses rotation, the holding bodies 551*a* and 551*b* oscillate in an N2 direction, and the pressure applied by the hard pad 542 is reduced.

The pressure is switched by the operation of the pressure applicator 59 in accordance with the measurement of the conveyed sheet S in a roller axis direction (hereinafter referred to as the "sheet measurement") to correspond to either a first sheet size or a second sheet size that is larger than the first size.

Figure 5A:
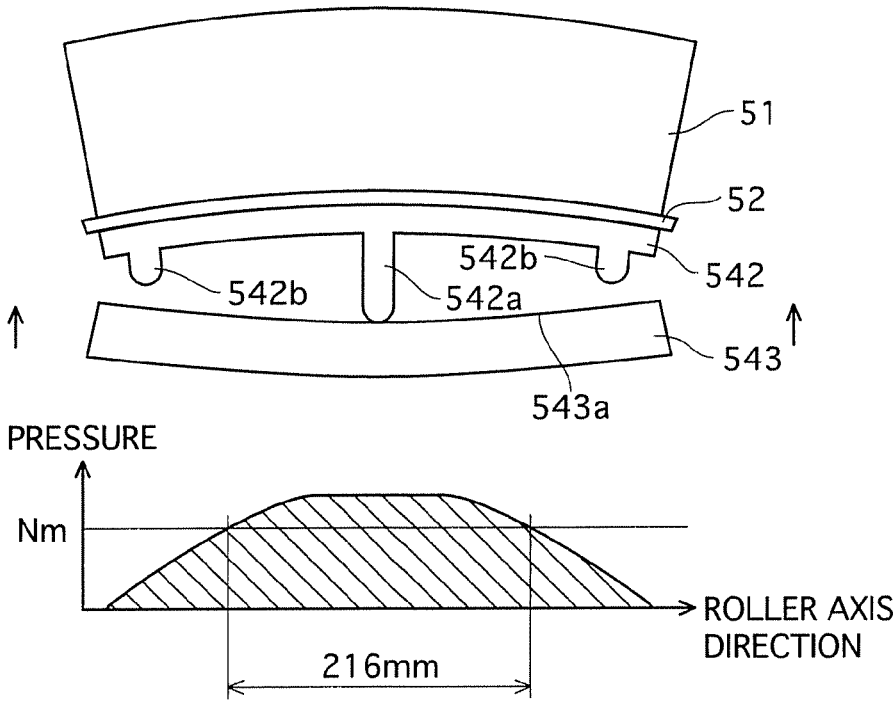
FIG. 5A is a characteristic drawing showing a pressure distribution in the roller axis direction of a fixing nip when a first magnitude of pressure is applied.
Figure 5B:
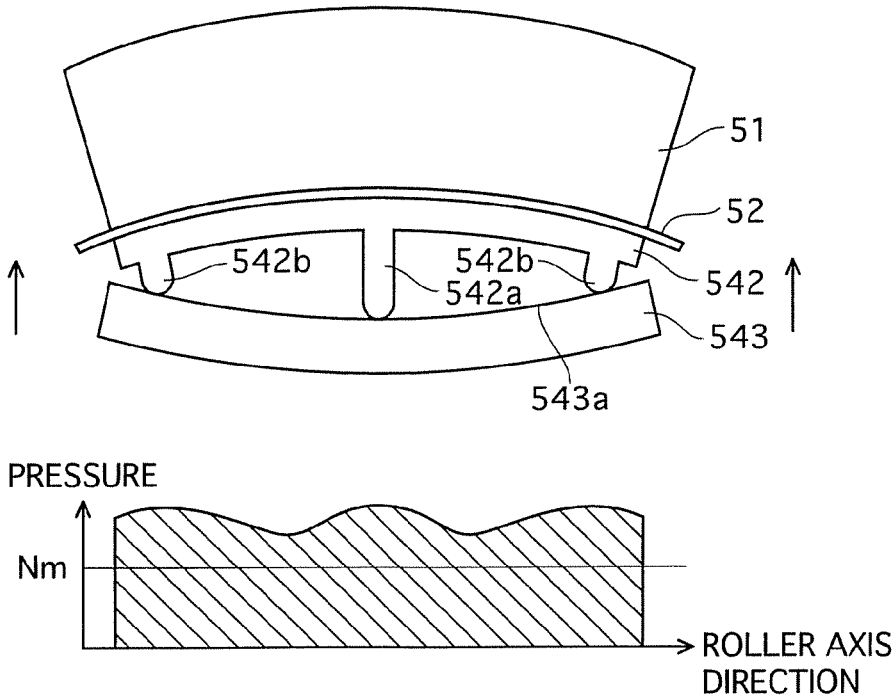
FIG. 5B is a characteristic drawing showing a pressure distribution in the roller axis direction of the fixing nip when a second magnitude of pressure is applied.

FIG. 5A shows a pressure distribution in the roller axis direction of the fixing nip 521 when the first magnitude of pressure is applied, and FIG. 5B shows a pressure distribution when the second magnitude of pressure is applied. Also, both drawings diagrammatically show conditions of the fixing roller 51, the hard pad 542, the support member 543, etc., when the first and second magnitudes of pressure are applied.

As shown in FIG. 5A, the pressure distribution when a first magnitude of pressure is applied is such that the pressure, in a 216 [mm] area in the center in the roller axis direction, is greater than or equal to a fixing pressure Nm which is the minimum necessary amount of fixing pressure to fix unfixed toner, and the pressure in other portions is below Nm. The reason for this type of pressure distribution is that, due to the structure of the hard pad 542 and the pressure application method described above, when the fixing roller 51, the hard pad 542, and so on bend, the projection 542*a* in the center of the hard pad 542 comes into contact with the support member 543, and the projections 542*b* at either end are in a state of being separated from the support member 543, so there is hardly any force from the pressure applicator 59 at work on portions on both ends of the hard pad 542. Hereinafter, the pressure distribution shown in FIG. 5A is referred to as low-pressure load distribution.

Meanwhile, as shown in FIG. 5B, the pressure distribution when a second magnitude of pressure is applied is such that the pressure in the entire area in the roller axis direction is greater than or equal to the predetermined fixing pressure Nm. In this case, the fixing roller 51, etc. bend further, and all of the projections 542*a* and 542*b* of the hard pad 542 come into contact with the support member 543, and force from the pressure applicator 59 is at work on an entirety of the support member 543 including both ends and the center in the roller axis direction. Hereinafter, the pressure distribution shown in FIG. 5B is referred to as high-pressure load distribution. The following describes details of the pressure distribution switch control.

A state of low-pressure load distribution (the second state) is detected by a detection sensor 82*a*, and a state of high-pressure load distribution (the first state) is detected by a detection sensor 81*a*.

As shown in FIG. 4, the detection sensor 81*a* is a conventional transmission-type optical sensor having a light emitter 811*a* and a light receptor 811*b*, and is disposed on the axis support plate 552*a*. When the fan-shaped gear 573*a* begins to oscillate in direction L1 (the direction in which the pressure increases), the light-shielding plate 81*b*, which is in a state of blocking the light emitted from the light emitter 811*a*, moves out from between the light emitter 811*a* and the light receptor 811*b*, thereby allowing the light emitted from the light emitter 811*a* to be received by the light receptor 811*b*. Upon the switch to this transmission state, the detection sensor 81*a* outputs a signal (high-pressure distribution signal) to that effect to the controller 6 (see FIG. 1). Upon receiving the high-pressure distribution signal, the controller 6 detects that the pressure distribution has become the high-pressure load distribution.

As shown in FIG. 2, similarly to the detection sensor 81*a*, the detection sensor 82*a* is a transmission-type optical sensor, and is mounted on the main frame (not depicted) of the fixer 5.

The detection sensor 82*a* outputs a signal indicating a rotation rate of the gear 572*h* to the controller 6. Specifically, intercepting fragments 82*b* that are arranged around a circumference direction of the gear 572*h* pass through a gap between the light emitter and the light receptor of the detection sensor 82*a*, thereby switching between a light-intercepting state and a transmission state. In accordance with the switching, the detection sensor 82*a* outputs, as a rotation rate signal, a pulse signal in which an L and an H level repeatedly alternate.

When in a high-pressure load distribution state, after the fan-shaped gear 573*a* starts oscillating in direction L2 (the direction in which pressure is reduced), the controller 6 counts the number of rising edges of the H level in a rotation rate signal, and detects a change to a low-pressure load distribution state when the count reaches a predetermined value.

Structure of Controller 6

Figure 6:
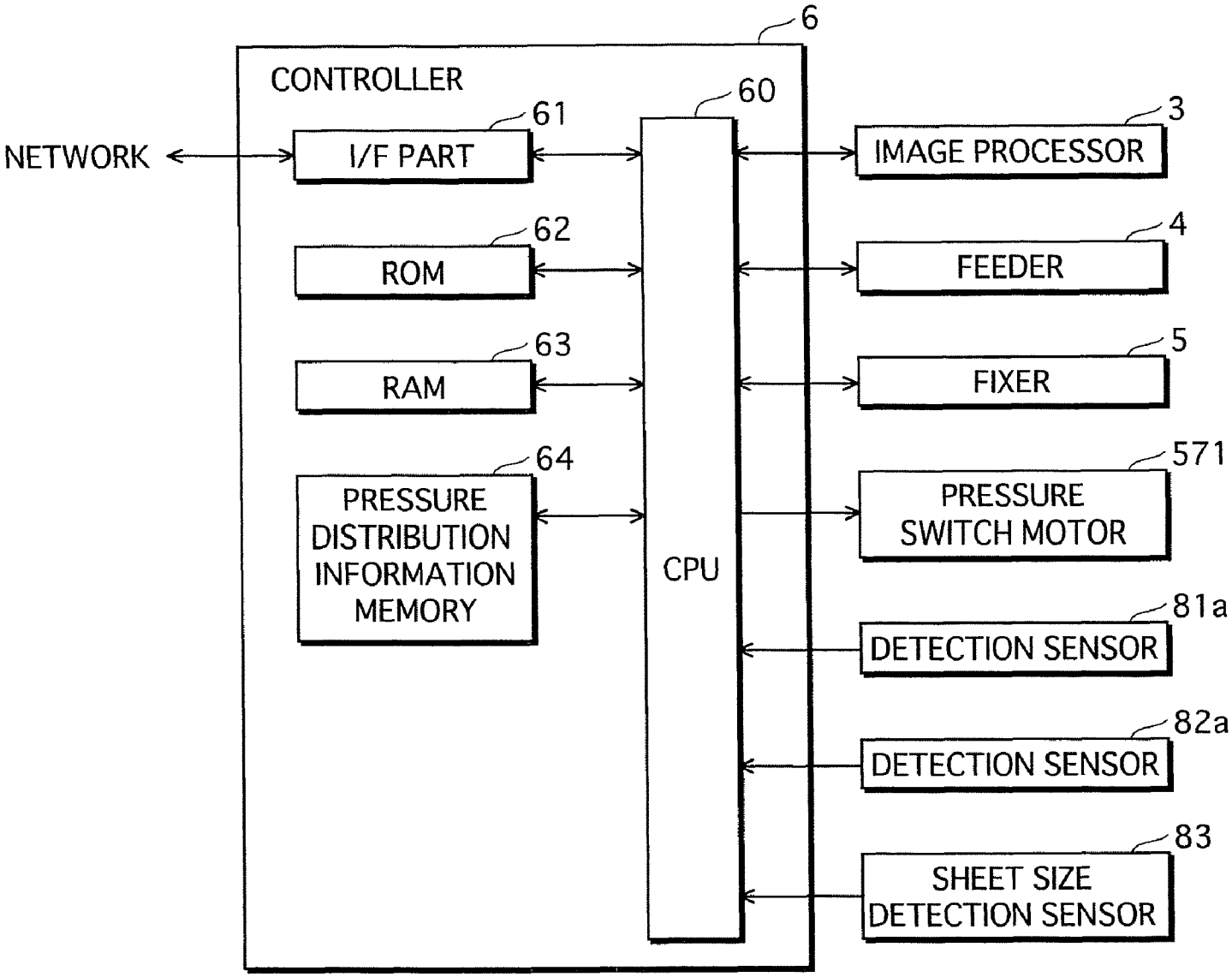
FIG. 6 is a block diagram showing a structure of a controller.

FIG. 6 is a block diagram showing a structure of the controller 6.

As shown in FIG. 6, the controller 6 includes, as main constituent elements, a CPU 60, a communication interface (I/F) part 61, a ROM 62, a RAM 63, and a pressure distribution information memory 64.

The I/F part 61 is an interface, such as a LAN card, for connecting to a network.

The RAM 63 is used as a work area for the CPU 60 while the CPU 60 executes a program.

The pressure distribution information memory 64 stores pressure distribution information. FIG. 7 shows the content of the pressure distribution information. As shown in FIG. 7, the pressure distribution information correlates sheet size, sheet measurement, and pressure distribution. Here, "portrait" in the sheet size means that the sheet is conveyed in an orientation such that a lengthwise direction of the sheet corresponds to the sheet conveyance direction, and "landscape" means that the sheet is conveyed in an orientation such that a lengthwise direction of the sheet is orthogonal to the sheet conveyance direction.

The sheet measurement is shown in accordance with sheet sizes determined by international standards or Japanese Industrial Standards (JIS).

Pressure distribution P1 indicates the high-pressure load distribution described above, and P2 indicates low-pressure load distribution.

The CPU 60 reads necessary programs from the ROM 62, and causes execution of smooth print operations by uniformly controlling operations of the image processor 3, the fixer 5, etc., in accordance with appropriate timings. Also, based on a signal from the sheet size detection sensor 83, the CPU 60 detects the size of the sheet S that is to be conveyed and whether the sheet S is conveyed in the portrait or landscape orientation.

Also, before printing begins, the CPU 60 refers to the pressure distribution information, judges a sheet measurement corresponding to the sheet S that is being conveyed, selects a pressure distribution P1 or P2 corresponding to the judged sheet measurement, and executes pressure distribution switch processing to switch to the selected pressure distribution.

Pressure Distribution Switch Processing

Figure 8:
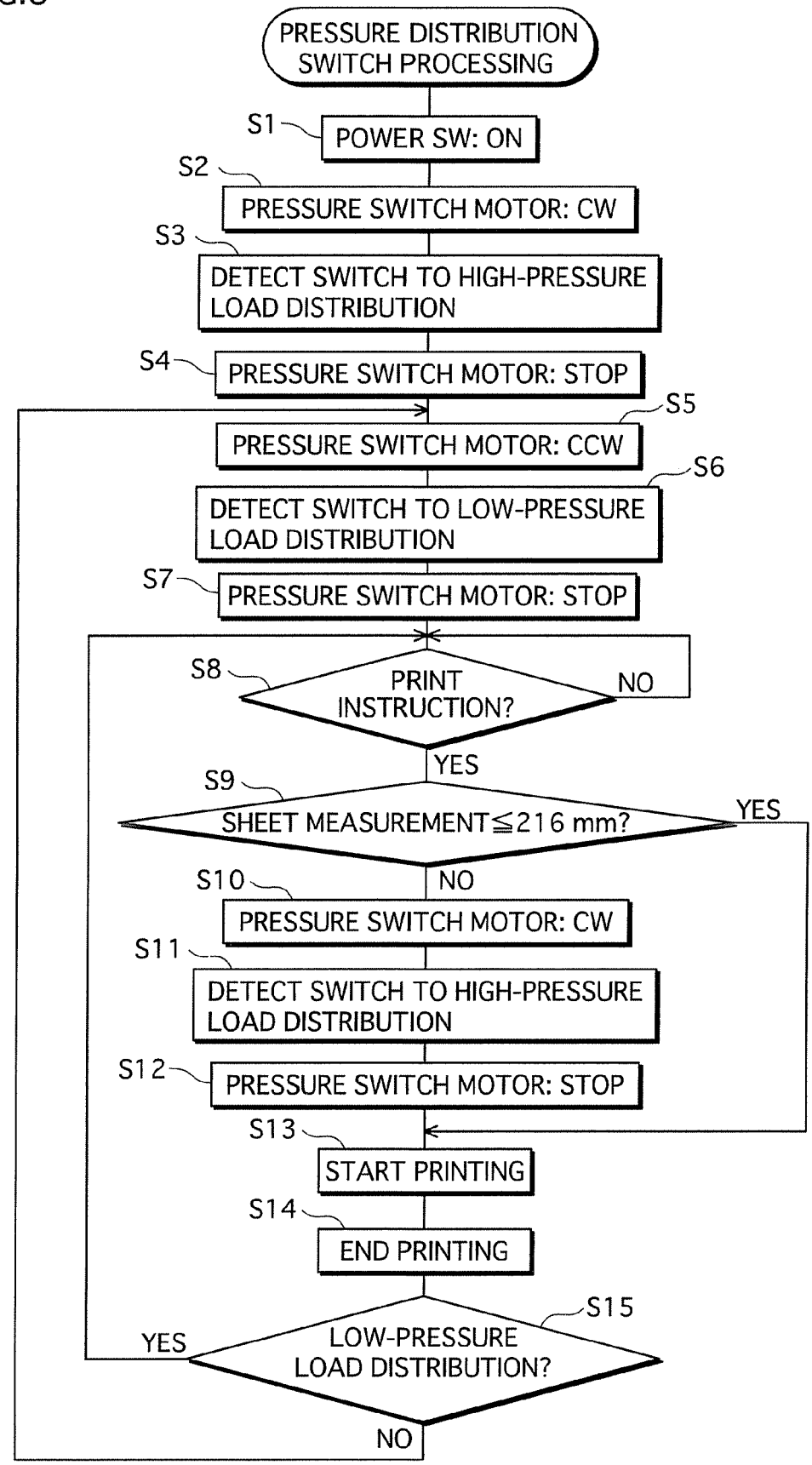
FIG. 8 is a flowchart showing exemplary content of pressure distribution switch processing.

FIG. 8 is a flowchart showing exemplary content of pressure distribution switch processing. The processing is started when in the low-pressure load distribution state.

As shown in FIG. 8, upon a power SW (switch) being turned ON (step S1), the pressure switch motor 571 is rotated clockwise (CW) (step S2). The pressure increases, and upon detection of a switch from low-pressure load distribution (FIG. 5A) to high-pressure load distribution (FIG. 5B)(step S3), the pressure switch motor 571 is stopped (step S4).

Next, the pressure switch motor 571 is rotated counter-clockwise (CCW) (step S5). The pressure decreases, and upon detection of a switch from high-pressure load distribution to low-pressure load distribution (step S6) the pressure switch motor 571 is stopped (step S7).

Then, whether a print instruction has been received is judged. If a print instruction does not exist (step S8:NO), a standby state is maintained. While in standby, a low-pressure load distribution state, also called the second state, is maintained. This enables reducing the pressure applied to the fixing roller 51 from the inner face of the pressure belt 52 and suppressing the load borne by the end of the fixing roller 51 while in standby, thereby suppressing deformation of the fixing roller 51.

If a print instruction exists (step S8:YES), whether the measurement of the sheet S being conveyed is less than or equal to 216 [mm] is judged (step S9). If the sheet measurement is judged to be less than or equal to 216 [mm], specifically, if the sheet size is A4 portrait or B5 portrait (step S9:YES), printing is started while in the same state, specifically while keeping the fixer 5 in a low-pressure load distribution state (step S13).

As shown in FIG. 5A, the low-pressure load distribution is such that the pressure is greatest in the center of the hard pad 542, and becomes gradually less towards both ends, similar to a mountain shape. At this time, the pressure is greater than or equal to Nm, as described above, in a range of 216 [mm] in the center in the roller axis direction, and the other portions have less pressure than Nm. Accordingly, reducing pressure to portions of the pressure belt 52 that are unnecessary for the fixing enables suppressing erosion of the pressure belt 52 while reliably executing fixing of the sheet S.

If the sheet measurement of the conveyed sheet S is judged to exceed 216 [mm], or specifically if the sheet size is A3 portrait, A4 landscape, B4 portrait, or B5 landscape (step S9:NO), the pressure switch motor 571 is rotated clockwise (step S10), and when a switch to the high-pressure load distribution is detected(step S11), after the pressure switch motor 571 is stopped (step S12), printing is started (step S13).

As shown in FIG. 5B, in the high-pressure load distribution, the pressure exceeds the fixing pressure Nm throughout the entire area in the roller axis direction. Accordingly, fixing can be executed reliably throughout the entire area of the roller axis direction even when the sheet size is large.

When printing has ended (step S14), whether the current state is low-pressure load distribution is judged (step S15). If the state is judged to be low-pressure load distribution (step S15:YES), the printer enters the standby state until the print instruction is received.

If the state is not low-pressure load distribution, that is, if the state is judged to be high-pressure load distribution (step S15:NO), processing returns to step S5, and the processing of steps S5 to S7 is executed. Specifically, when the pressure switch motor 571 is rotated counter-clockwise, and a switch to a low-pressure load distribution is detected, the printer enters standby until there is a print instruction.

The fixer 5 of the embodiment, as described above, can change the pressure distribution in accordance with the sheet measurement of the sheet to be conveyed. Therefore, for example, if the printer 1 is disposed in an environment where a small sheet size is frequently used, the proportion of executing printing in the low-pressure load distribution state is high, an erosion amount of the sliding sheet 53 or both sides of the pressure belt 52 in the roller axis direction can be reduced compared to a conventional system of maintaining the same constant pressure for any size. Accordingly, the load amount on the pressure belt 52 in the fixing nip 521 can be made less than in conventional technology, at least by as much as the load can be reduced on both sides in the roller axis direction, and it is possible to commensurately extend the life and reduce the frequency of replacement.

Variations

1. Although in the above embodiment, pressure is applied to the fixing roller 51 by the pressure belt 52, and the fixing roller 51 is heated, the present invention is not limited to this structure. Pressure may be applied to the pressure belt 52 by the fixing roller 51, and the pressure belt 52 may be heated.

2. Although in the above embodiment, the sheet measurement is judged based on sheet size, and the pressure distribution is switched in accordance with the judged sheet measurement, all that is required is knowing the sheet measurement. For example, a sensor that directly detects the sheet measurement of the sheet S may be used instead of the sheet size detection sensor 83, and a signal from the sensor indicating the sheet measurement may be used as information to indicate the sheet measurement. Also, since the sheet size and the sheet measurement have a one-to-one correspondence, for example, information correlating the sheet size and the pressure distribution may be stored in advance, the detected sheet size may be acquired as information indicating the sheet measurement, and the distribution may be switched in accordance with the detected sheet size.

3. Although in the above embodiment, force is applied to both ends of the elongated hard pad 542, and switching the force to the second stage to adjust the amount of bending of the hard pad 542 enables changing the pressure in the roller axis direction, the present invention is not limited to this structure. For example, translation actuators for applying pressure may be disposed at positions at both ends and in the center in the roller axis direction, and actuators may be switched to operate in accordance with the sheet measurement.

4. Although in the above embodiment, the pressure distribution is switched to the second stage if the sheet measurement is greater than or equal to 216 [mm], the present invention is not limited to this, and switching between three or more stages is possible. In such a case, disposing a plurality of translation actuators in the pressure belt in the roller axis direction enables configuring more precise stages for switching the pressure distribution.

5. Although in the waveforms of the above-described high-pressure load distribution, pressure peaks exist in three places, the formation of waveforms is not limited to this. For example, the pressure at the center in the roller axis direction may be lowered without falling below Nm, to realize a waveform having two peaks, one at either end of the pressure distribution. Accordingly, in an environment where small-sized paper is used at substantially the same rate as large-sized paper, erosion of the pressure belt or the sliding sheet can be reduced substantially uniformly across the entire area in the roller axis direction, and the replacement cycle of the pressure belt can be prolonged further.

6. Since in the above embodiment, for any size of the sheet S, the conveyance position is determined so that the center of the sheet with respect to the front and the back sides of the apparatus is aligned with the center of the conveyance path 43 in the roller axis direction, the waveform of the low-pressure load distribution is a mountain shape in which the peak is located in the center in the roller axis direction. However, for example if the sheet S is conveyed using a position at the back side of the apparatus as the reference, the pressure is applied so that in the waveform, the peak position is more toward the back side of the apparatus.

7. Although an example of a case in which the fixing apparatus of the present invention is applied to a tandem-type color digital printer is described in the above embodiment, the present invention is not limited to this. For example, the invention may be applied to a fixing apparatus of a copier, a fax machine, an MFP (Multiple Function Peripheral), etc., regardless of whether the image formation is color or monochrome, as long as the fixing apparatus secures a fixing nip by pressing together a fixing roller and a pressure belt and the nip is held therebetween.

8. Although in the present embodiment, the projections 542*a* and 542*b* of the hard pad 542 are formed as three pectinate projections, the present invention is not limited to this. The amount of projection of three or more projections may also become larger closer to the center of the hard pad 542.

Also, the present invention may be any combination of the above embodiment and the variations.

The present invention is not limited to a fixing apparatus, and may be a method of changing the pressure distribution. Furthermore, the present invention may be a program for executing the method on a computer. Also, the program pertaining to the present invention may be recorded to magnetic tape, a magnetic disk such as a flexible disk, an optical recording medium such as DVD-ROM, DVD-RAM, CD-ROM, CD-R, MO, or PD, or a computer-readable recording medium such as a flash-memory-type recording memory. The program may be produced and transferred in the form of the recording medium, and may also be transferred or distributed via telecommunication lines, radio communications, communication lines, or a network such as the Internet.

The present invention can be applied widely to belt-nip system fixing apparatuses.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing apparatus that fixes a toner image formed on a sheet by passing the sheet through a fixing nip, comprising:

a roller that is rotatably held;

a belt that revolves;

a pressing member disposed on an inner face of the belt, the pressing member pressing the belt from the inner face against a surface of the roller so that the fixing nip is formed between the belt and the roller; and a pressure controller that, in accordance with information indicating a measurement of the sheet in a roller axis direction, changes a pressure distribution in the roller axis direction, the pressure distribution being a distribution of the pressure applied to the roller by the pressing member;

wherein if the measurement of the sheet that is to pass through the fixing nip is of a first size, the pressure controller causes the pressing member to use a first pressure distribution in which a pressure on a site through which the sheet of the first size is anticipated to pass is greater than or equal to a necessary fixing pressure and a pressure on other sites is below the necessary fixing pressure, and if the measurement of the sheet that is to pass through the fixing nip is of a second size that exceeds the first size, the pressure controller causes the pressing member to use a second pressure distribution in which a pressure on all sites is greater than or equal to the necessary fixing pressure; and wherein the pressing member is made of an elongated, bendable bar material, a plurality of pectinate projections being formed on one face thereof, a central one of the projections, with respect to a length direction of the pressing member, projecting farther than ones of the projections in a vicinity of ends of the pressing member, the pressure controller includes a support member that supports the pressing member, and a pressure applicator, the support member supporting the pressing member so as to at least be in contact with the central projection, the pressure applicator applying pressure to the pressing member via the support member, and if the sheet is of the first size, the pressure applicator applies a first pressure, and if the sheet is of the second size, the pressure applicator applies a second pressure that is greater than the first pressure.

2. The fixing apparatus of claim 1, wherein while the first pressure is being applied, only the farthest-projecting central projection of the pressing member is in contact with the support member, and the pressure applied to the fixing nip is transmitted only via the central projection, and while the second pressure is being applied, all of the projections are in contact with the support member, and the pressure applied to the fixing nip is transmitted via all of the projections.

3. An image formation apparatus that forms an image on a sheet by passing the sheet through a fixing nip and fixing a toner image on the sheet, comprising:

a roller that is rotatably held;

a belt that revolves;

a pressing member, provided on an inner side of the belt and held in a state of pressing against a surface of the roller via the belt, so that the fixing nip is formed between the belt and the roller;

a judgment part that judges a size of the sheet to be conveyed through the fixing nip; and a pressure controller that, in accordance with the judged measurement of the sheet in a roller axis direction, changes a pressure distribution in the roller axis direction, the pressure distribution being a distribution of the pressure applied to the roller by the pressing member;

wherein if the measurement of the sheet that is to pass through the fixing nip is of a first size, the pressure controller causes the pressing member to use a first pressure distribution in which a pressure on a site through which the sheet of the first size is anticipated to pass is greater than or equal to a necessary fixing pressure and a pressure on other sites is below the necessary fixing pressure, and if the measurement of the sheet that is to pass through the fixing nip is of a second size that exceeds the first size, the pressure controller causes the pressing member to use a second pressure distribution in which a pressure on all sites is greater than or equal to the necessary fixing pressure; and wherein the pressing member is made of an elongated, bendable bar material, a plurality of pectinate projections being formed on one face thereof, a central one of the projections, with respect to a length direction of the pressing member, projecting farther than ones of the projections in a vicinity of ends of the pressing member, the pressure controller includes a support member that supports the pressing member, and a pressure applicator, the support member supporting the pressing member so as to at least be in contact with the central projection, the pressure applicator applying pressure to the pressing member via the support member, and if the sheet is of the first size, the pressure applicator applies a first pressure, and if the sheet is of the second size, the pressure applicator applies a second pressure that is greater than the first pressure.

4. The image formation apparatus of claim 3, wherein the pressing member is elongated in shape, and the pressure controller changes the pressure applied to an end of the pressing member in a length direction.

5. The image formation apparatus of claim 4, wherein the pressure controller switches, in accordance with the size of the sheet, between a first state in which the pressure at the end of the pressing member is greater than or equal to a predetermined pressure necessary for fixing, and a second state in which the pressure at the end of the pressing member is less than the predetermined pressure necessary for fixing.

6. The image formation apparatus of claim 5, wherein the pressure controller maintains the second state when image formation is not being performed.

* * * * *